US006427702B1

(12) United States Patent
Silva

(10) Patent No.: US 6,427,702 B1
(45) Date of Patent: Aug. 6, 2002

(54) HAIR FASTENER

(76) Inventor: David Alan Silva, 632 Loma Prieta, Aptos, CA (US) 95003

( * ) Notice: Subject to any disclaimer, the term of this patent is extended or adjusted under 35 U.S.C. 154(b) by 0 days.

(21) Appl. No.: 09/922,025

(22) Filed: Aug. 2, 2001

(51) Int. Cl.[7] ..... A45D 8/12; A45D 24/38; A45D 24/00

(52) U.S. Cl. ..... 132/275; 132/144; 132/147

(58) Field of Search ..... 132/275, 144, 132/147, 146, 106, 121, 125, 130, 154, 155, 158

(56) References Cited

U.S. PATENT DOCUMENTS 8,258 * 6/1834 Porter 132/144
91,984 A * 6/1869 Stackhouse ..... 132/144
174,059 A * 2/1876 Britton ..... 132/144
1,488,954 A * 4/1924 Trachtenberg ..... 132/144
1,708,419 A * 4/1929 Jurich ..... 132/144
4,359,061 A * 11/1982 Colclasure ..... 132/144
5,275,182 A * 1/1994 Northcutt ..... 132/144

* cited by examiner

*Primary Examiner*—John J. Wilson
*Assistant Examiner*—Robyn Kieu Doan

(57) ABSTRACT

A hair fastener comprising a comb with two of the teeth having a male fastener integrally attached to them for mating with a female detachable locking member. The detachable locking member is attached over the end of the comb's teeth, for hiding the male fastener within the locking member and for securing the hair section in the spaces between the comb teeth portion that is between the comb base and the locking member.

4 Claims, 2 Drawing Sheets

HAIR FASTENER

BACKGROUND OF THE INVENTION

1. Field of the invention

The present invention relates to a hair fastener and method. More particularly, a comb with a detachable bar attached to the end of the comb's teeth for securing hair between the comb base and the bar.

2. Description of prior art

Many people like to secure and style their hair away from their face with various hair combs. A single retaining comb and a double, hinged together, comb ("banana" type hair clip) are the most commonly used. Both hold hair, however, the retaining comb often becomes loose over time and the "banana" type hair clip can only gather hair into a "Mohawk" shape along the middle of the head by combining from both sides, into the center, and connecting above and below the hair section.

The present invention embodies a comb with a detachably connected bar that ahs an elongated channel attached over the comb teeth ends. It allows the user to place the entire comb into a hair section with all its teeth penetrating through the other side of the hair section, and secure the hair between the comb base and the detachably connected bar. The bar covers and hides the teeth ends, it mirrors the comb bases it holds the hair between the comb base and bar, and it keeps the comb from reversing back out of the hair.

SUMMARY OF THE PRESENT INVENTION

An object of the present invention is to provide a locking comb, which is convenient, practical, and expensive for use in hair fastening.

A further object is to provide such an instrument that has a bar that is attachable and detachable to a comb's teeth ends to secure hair in the space between the comb teeth and the bar.

A further object is to provide such an instrument where all the comb teeth can be placed into a hair section and then pushed back out the other side of the section where the bar can be attached to the comb's teeth ends to secure the comb in place.

A further object is to provide such an instrument that can be used unassisted by the individual styling their hair, eliminating the expense of a professional stylist.

A further object is to provide such an instrument that can be used to comb the user's hair before being used as a fastener.

A further object is to provide such an instrument that will quickly hold the user's hair up in a multitude of neatly secured styles.

A further object is to provide such an instrument that doesn't become loose on the user's head.

A further object is to provide such an instrument, wherein, the attachable/detachable bar mirrors the shape oft he comb base for aesthetic reasons.

A further object is to provide such an instrument that can have a length of fabric attached to the comb base and also to the locking bar member for covering the hair fastened between the bar and the comb base.

According to one aspect of the present invention, there is provided a locking comb comprising, a comb with a notch on the far right and far left of its teeth ends, and a locking bar that attaches to the teeth notches by a ledge at the ends of the bar.

According to the arrangement described above the comb is placed into a hair section and the locking bar is attached to the comb teeth ends to secure the hair in place.

Accordingly a preferred embodiment of the present invention the comb and locking bar are made of plastic, the comb base mirrors the shape of the bar, and the bar is hollowed out on one side creating a channel or a plurality of openings so the teeth ends can be placed into it to secure.

Other objects, features and advantages of the present invention will become apparent from the following description of the preferred embodiments given with reference to the accompanying drawings.

DETAILED DESCRIPTION OF THE PREFERRED EMBODIMENTS

Figure 1:
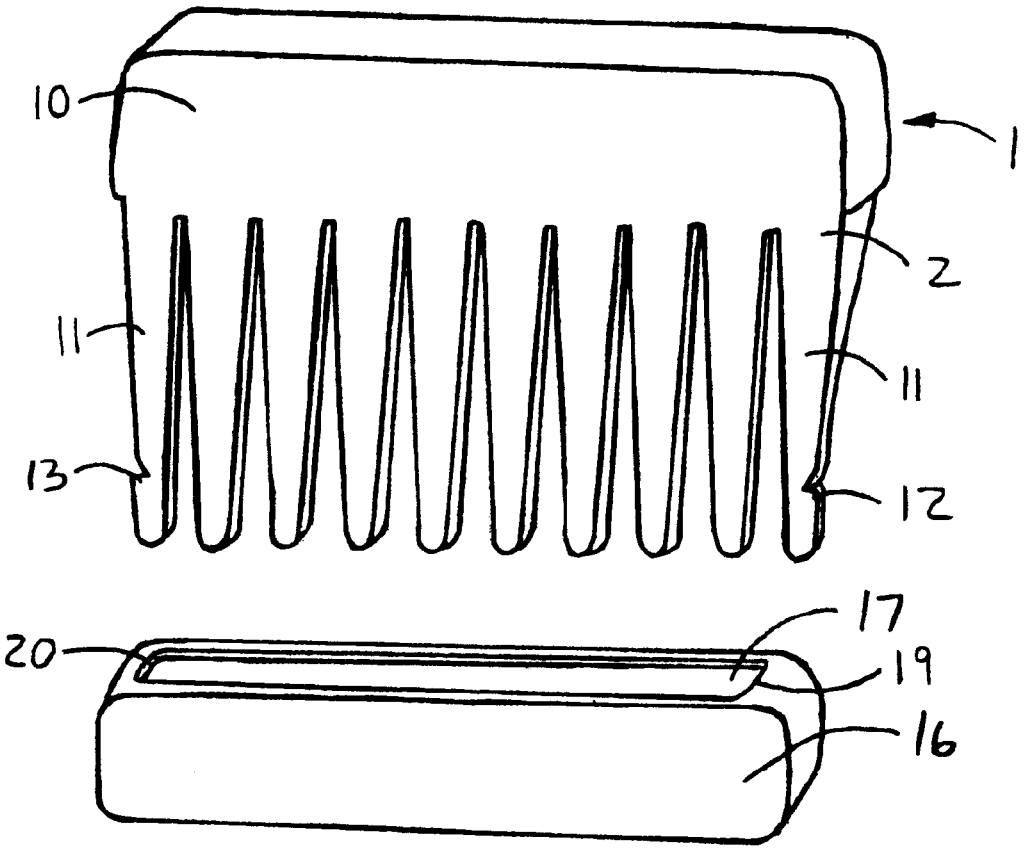
FIG. 1 is a plan view showing the comb and locking bar according to the present invention.
Figure 2:
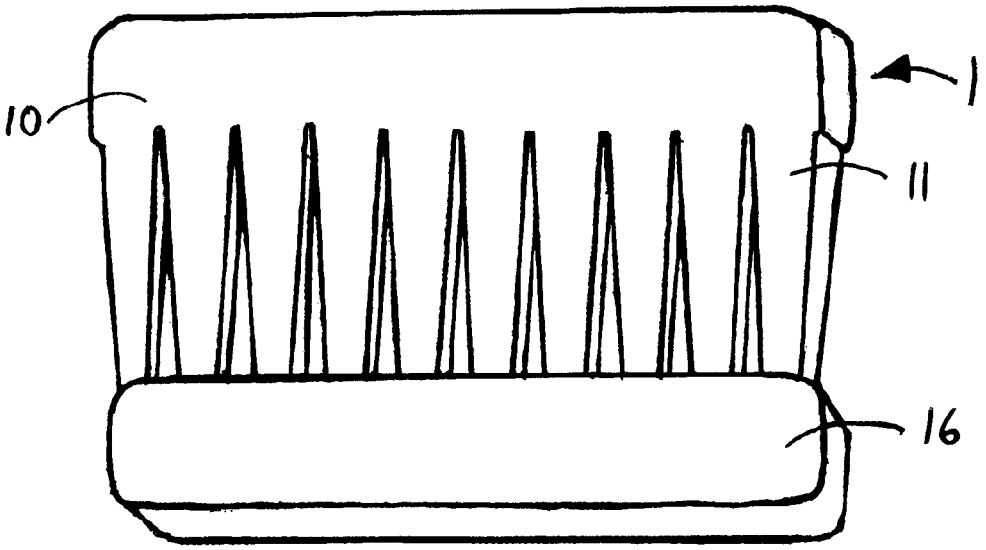
FIG. 2 is a schematic view of the hair fastener secured to the user's hair.

Referring to FIGS. 1 and 2 of the accompanying drawings. There is illustrated a hair fastener embodying the present invention. The hair fastener, generally designated by reference numeral 1, comprises a first comb 2 comprising a base 10 with a plurality of comb teeth 11 attached to comb base 10. The teeth 10 have two teeth 12 and 13 that have a notch 14 and 15 at their end A bar 16 has an opening 17 and at each end of bar 16 there is a ledge 19 and 20 for engaging the teeth 12 and 13 to the bar 16.

Figure 3:
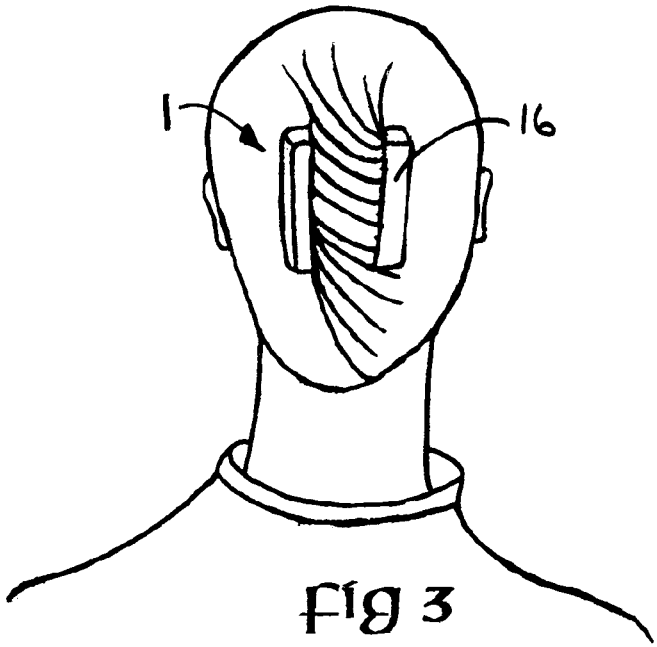
FIG. 3 is a plan view of another embodiment of the current invention.

In use FIG. 3 of the hair fastener 1 described above, the comb teeth 11 are put into the hair. Bar 16 is fastened to teeth ends 11 by placing bar opening 17 over teeth 11 and engaging notches 14 and 15 on teeth 12 and 13 with ledges 19 and 20 on bar 16.

Figure 4:
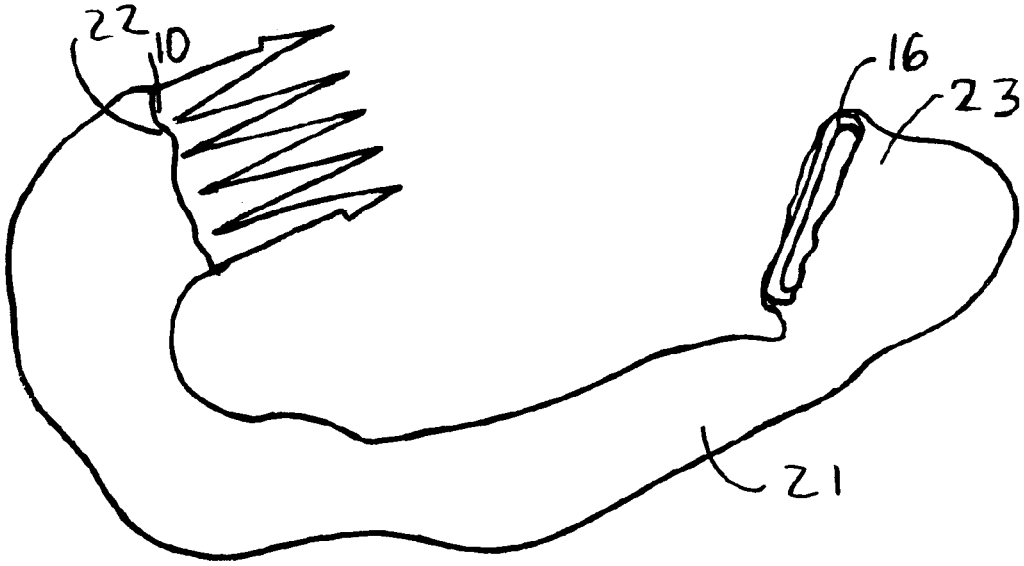
FIG. 4 is a plan view of another embodiment of the current invention.

FIG. 4 shows a length of fabric 21 with one of its ends 22 attached to comb base 10 and with the other fabric end 23 attached to the bar 16. The use is the same, however, the fabric substantially covers the hair secured between the comb base and the bar.

The present invention being thus described, it is obvious that the same embodiment and uses may be varied in many ways. For instance, the comb and bar portions can be of different shapes, sizes or configurations as long as the comb ends have a way to move through the hair without interruption and have a male attachable/detachable member on at least two of the comb's teeth ends for mating with any type of female attachable/detachable member on the bar and the bar remains at a substantial distance from the comb base. While the comb base usually mirrors the locking bar it doesn't have to; the comb base could just correspond to the bar aesthetically. For example the base could be the tip of an arrow shape and the bar could be the rest of the arrow shape so it looks like the arrow is stuck through the hair section. The fabric portion can be of different shapes, sizes, or materials, such as cotton, elastic or a swatch of hair. Further, any way to style the hair with the present invention applies such as placing the comb teeth into the hair ends and rolling the comb up and then placing the bar to the teeth. Such variations are not to be regarded as a departure from the spirit and scope of the invention, and all such variations as would be obvious to those skilled in the art are intended to be included within the scope of the following claims,

I claim:

1. A hair fastener for use in styling hair of a human being comprising:

a comb having a comb base with a plurality of elongated teeth attached to said comb base; and, a male attaching means at the tip end of at least two of said elongated comb teeth for mating with a detachable locking member at a substantial distance from said comb base and covering only said comb teeth tips;

said detachable locking member comprising: a female attaching means on said locking member, for mating with and substantially covering said male attaching means; said detachable locking member attaches over said male attaching means only at said teeth tips, while the rest of said teeth remain uncovered by said detachable locking member;

whereby, all said elongated comb teeth are placed into a hair section and said detachable locking member is attached to said comb teeth ends at a substantial distance from said comb base to hide said male attaching means within said female attaching means and to secure said hair section in the spaces between the comb teeth portion between said comb base and said locking member.

2. The hair fastener of claim 1 wherein the locking member mirrors the shape of the comb base.

3. A method for securing and styling hair, said method comprising the steps of:

inserting a plurality of elongated comb teeth of a comb into a hair section, said comb teeth having a male attaching means at the tip end of at least two said teeth; attaching a locking member, with a female attaching means, over said male attaching means at a substantial distance from said comb base; said detachable locking member attaches over said male attaching means only at said teeth tips, while the rest of said teeth remain uncovered by said detachable locking member to hide said male attaching means within said female attaching means and to secure said hair section in the spaces between the comb teeth portion between said comb base and said locking member.

4. A hair fastener for use in styling hair of a human being comprising:

a comb having a comb base with a plurality of elongated teeth attached to said comb base; and, a male attaching means at the end of at least two of said elongated comb teeth for mating with a detachable locking member at a substantial distance from said comb base;

said detachable locking member comprising: a female attaching means on said locking member, for mating with and substantially covering said male attaching means;

a first end of a length of fabric is attached by attaching means to said comb base and a second end of said fabric is attached my attaching means to said detachable locking member, whereby, all said elongated comb teeth are placed into a hair section and said detachable locking member is attached to said comb teeth ends at a substantial distance from said comb base to hide said male attaching means within said female attaching means and to secure said hair section in the spaces between the comb teeth portion between said comb base and said locking member.

* * * * *